United States Patent [19]

Zielinski

[11] 3,964,365

[45] June 22, 1976

[54] DEVICE FOR UTILIZING PART OF THE RECOIL ENERGY OF A WEAPON

[75] Inventor: Erich Zielinski, Gruiten, Germany

[73] Assignee: Rheinmetall G.m.b.H., Dusseldorf, Germany

[22] Filed: July 8, 1974

[21] Appl. No.: 486,514

[30] Foreign Application Priority Data

July 13, 1973 Germany ..... 2335649

[52] U.S. Cl. ..... 89/43 R

[51] Int. Cl.² ..... F41F 19/02

[58] Field of Search ..... 89/4 R, 4 A, 4 B, 43 R

[56] References Cited

UNITED STATES PATENTS

| | | | |
|---|---|---|---|
| 497,704 | 5/1893 | Canet | 89/43 R |
| 531,157 | 12/1894 | Canet | 89/4 R |
| 565,610 | 8/1896 | Deport | 89/43 R |
| 696,063 | 3/1902 | Meigs et al. | 89/43 R |
| 1,344,499 | 6/1920 | Gabbett et al. | 89/185 |

FOREIGN PATENTS OR APPLICATIONS

| | | | |
|---|---|---|---|
| 1,319 | 1902 | United Kingdom | 89/4 R |

*Primary Examiner*—Stephen C. Bentley
*Attorney, Agent, or Firm*—Ernest G. Montague; Karl F. Ross; Herbert Dubno

[57] ABSTRACT

The invention relates to a device for extracting part of the recoil energy of a weapon utilizing a barrel-braking- and counter-recoil system. A piston moving in a hydraulic cylinder is attached to a barrel; a storage-cylinder compresses a fluid during the recoil of the barrel, the fluid's stored energy being made use of during the counter-recoil movement of the barrel for actuating an auxiliary mechanism.

8 Claims, 4 Drawing Figures

DEVICE FOR UTILIZING PART OF THE RECOIL ENERGY OF A WEAPON

FIELD OF THE INVENTION

My invention relates to a device for extracting part of the recoil energy of a weapon during a counter-recoil movement of the barrel of the weapon.

BACKGROUND OF THE INVENTION

U.S. Pat. No. 2,410,116 describes a device for a gun having a barrel coupled to the piston of a cylinder. During the recoil movement the piston compresses a gas in a storage cylinder having a floating piston acting as an energy-storage device. The stored energy is available to actuate a number of weapon functions, such as opening and closing of a breech lock, and actuation of the ejector and a plunger or other mechanism.

In the known device energy is also removed during the return movement of the barrel, which is undesirable for a number of reasons; it would be preferable to first store the recoil energy during the barrel's recoil and to either make use of the remaining energy or to convert it into heat during return of the barrel to its starting position. Since hydro-pneumatic barrel-braking and counter-recoil systems already make use of an energy-storage device, for reasons of both spatial and cost economy it should not be required to provide a further storage device; it, however, is nevertheless necessary to replenish the hydraulic medium displaced from the counter-recoil mechanism during the energy-discharge phase. It is furthermore desirable to remove only enough energy so as not to detrimentally influence the normal counter-recoil movement.

OBJECTS OF THE INVENTION

It is accordingly an objective of my invention to obviate the aforesaid disadvantages of the apparatus used heretofore, and to provide a weapon and a method where energy stored during the recoil phase is removed during the counter-recoil phase or shortly thereafter without in any way detrimentally affecting the normal counter-recoil movement of the barrel of the weapon.

SUMMARY OF THE INVENTION

The recoil energy of a weapon utilizing a barrel-braking and counter-recoil sysem is retrieved during the counter-recoil movement of the barrel of the weapon. The former entrains a piston moving within a hydraulic cylinder and causes the opening of a disk valve; the released fluid forces a floating piston to compress gas in a storage chamber or pressure accumulator. Upon conclusion of the recoil movement the barrel moves forward again, the disk valve closes, and the fluid streaming through throttle openings in the disk valve pushes the piston back, initiating the counter-recoil movement of the barrel, and also causing a pressure differential across the disk valve during the movement of the barrel. This pressure differential acting on opposite sides of an auxiliary piston, causes a backward movement of the latter compressing fluid in an auxiliary chamber; when the auxiliary piston is required to perform work, such as actuation of another mechanism, the pressure on opposite sides of the piston is equalized by a check valve, and the auxiliary piston is acted upon by fluid pressure from the floating piston due to the expanding gas in the accumulator, forcing the auxiliary piston forward for the actuation of another mechanism. An alternate version of my invention provides for a unitary, coaxial construction of the storage and auxiliary cylinders and for a fluid reservoir to replenish any leaks of the hydraulic fluid.

According to the method aspect of my present invention the initial recoil acceleration of the barrel is used to displace a hydraulic medium which effects hydraulic braking, the displaced medium compressing a gas in a pressure accumulator to store a pressure therein. During the subsequent intermediate phase of the recoil movement of the barrel the stored energy of the accumulator is converted into hydraulic pressure which is utilized to operate a load and, in a final phase of the movement of the barrel, the residual stored energy in the accumulator is fully utilized to drive the barrel forwardly into its firing position.

BRIEF DESCRIPTION OF THE DRAWING

These and other features of my invention will be better understood with reference to the accompanying drawing in which:

FIG. 2*a* shows a cross-section of FIG. 2 along lines II*a* — II*a.

SPECIFIC DESCRIPTION

Figure 1:
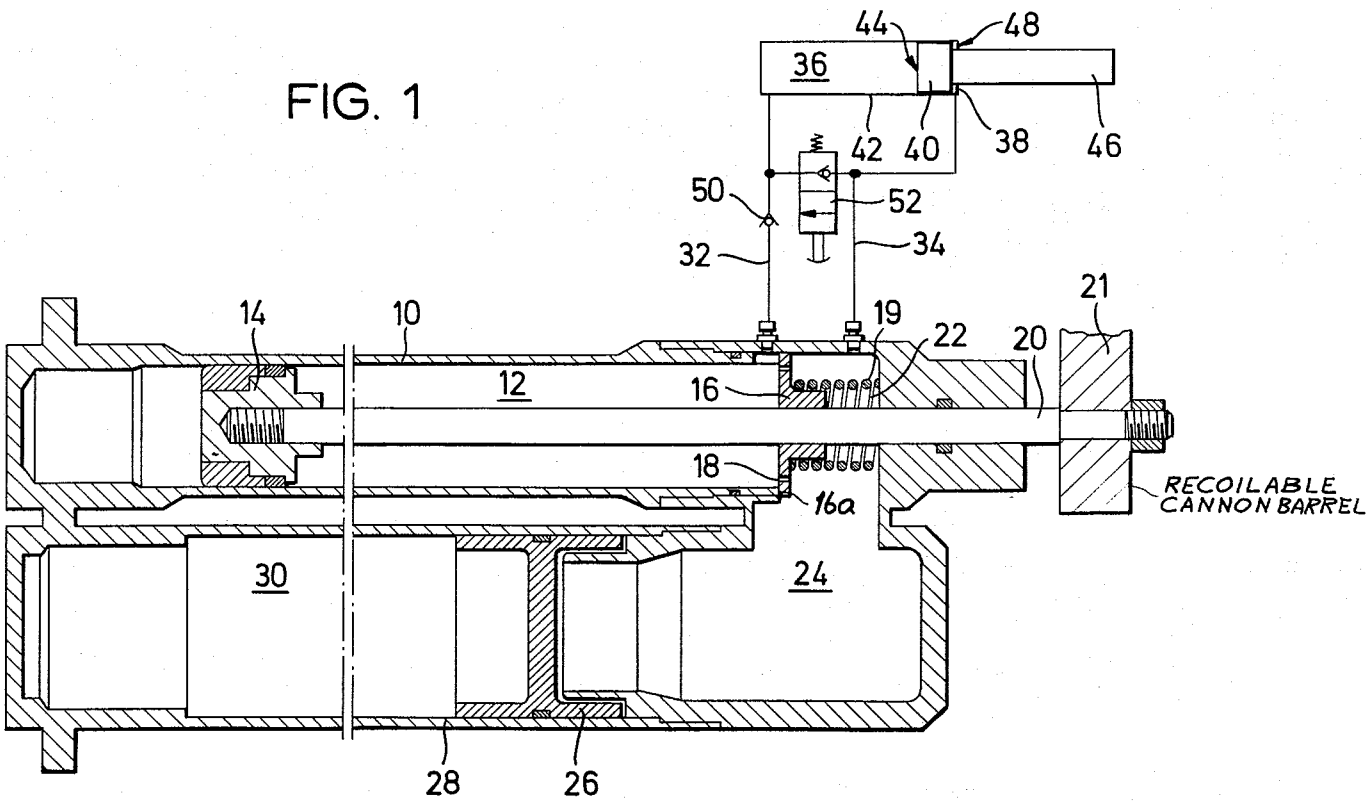
FIG. 1 shows a fragmentary section of a simple version of my invention in elevation.

FIG. 1 shows a hydraulic cylinder 10 formed with a chamber 12 filled with a hydraulic fluid, chamber 10 being closed off on one end by a piston 14, and on the other end by a disk valve 16 formed with throttle openings 18. A spring 19 applies pressure on disk valve 16 to urge it against its valve seat 16*a*, and piston 14 is connected via a piston rod 20 to a weapon or a part thereof, such as, for example, a recoilable cannon barrel 21.

A chamber 22 behind disk valve 16 communicates with a chamber 24 bounded by a floating piston 26, the latter sliding within a hydropneumatic cylinder or accumulator 28, having a storage space 30 filled with gas.

Upon the firing of a round, barrel 21 recoils and thereby entrains piston 14 in the direction of disk valve 16, i.e. piston 14 moves to the right in FIG. 1. Disk valve 16 is displaced to the right away from its seat 16*a* as a result of the force differential across the former until the pressure differential across throttle bores 18 no longer exceeds the force of spring 19 as a result of equation; the hydraulic fluid therefore flows to all intents and purposes unthrottled into chamber 24, thereby forcing the floating piston 26 to the left, the latter thereby storing energy by compression of gas in storage space 30. Upon conclusion of the recoil movement, barrel 21 begins to move forward again, disk valve 16 closes, and the fluid streaming through throttlebores 18 pushes back piston 14, thus reinforcing the counter-recoil movement of the barrel. As the velocity of the counter-recoil movement increases, the pressure-drop across throttle openings 18 increases also; only when barrel 21 comes to rest in the initial firing position is the pressure across throttle openings 18 equalized; the portion of the weapon described this far is known.

During an intermediate part of the counter-recoil movement some energy is, however, shunted off and controlled by the pressure differential across throttle openings 18. Chambers 12 and 22 communicate respectively with cylinder chambers 36 and 38 via respective lines 32 and 34 ahead and behind a piston 40 sliding within a cylinder 42. In the event of equal pressure in chambers 36 and 38 piston 40 will remain in the position shown.

As soon as the pressure ratio of chamber 24 to chamber 12 exceeds the ratio of piston surfaces 44 to 48 during the counter-recoil movement, piston 40 starts moving towards chamber 36, and the fluid contained within chamber 36 begins to return via a check valve 50 to chamber 12 of cylinder 10, barrel 21 continuing its counter-recoil movement.

As soon as piston 40 is required to perform any work, i.e. to actuate another plunger or mechanism (load) the pressure in chambers 36 and 38 is equalized by means of a check valve 52; piston 40 is now acted upon by the pressure existing in storage space 30, transmitted via floating piston 26 to chamber 24 and line 34 and whence via check valve 52 to chamber 36, causing piston 40 to move in the direction of chamber 38. Valve 52 can be operated manually, or controlled by other elements of the weapon not shown in FIG. 1.

Piston rod 46 may, for example, actuate the release mechanism of a projectile, or perform any other function, the description of which is not essential for the purpose of my present invention.

Figure 2:
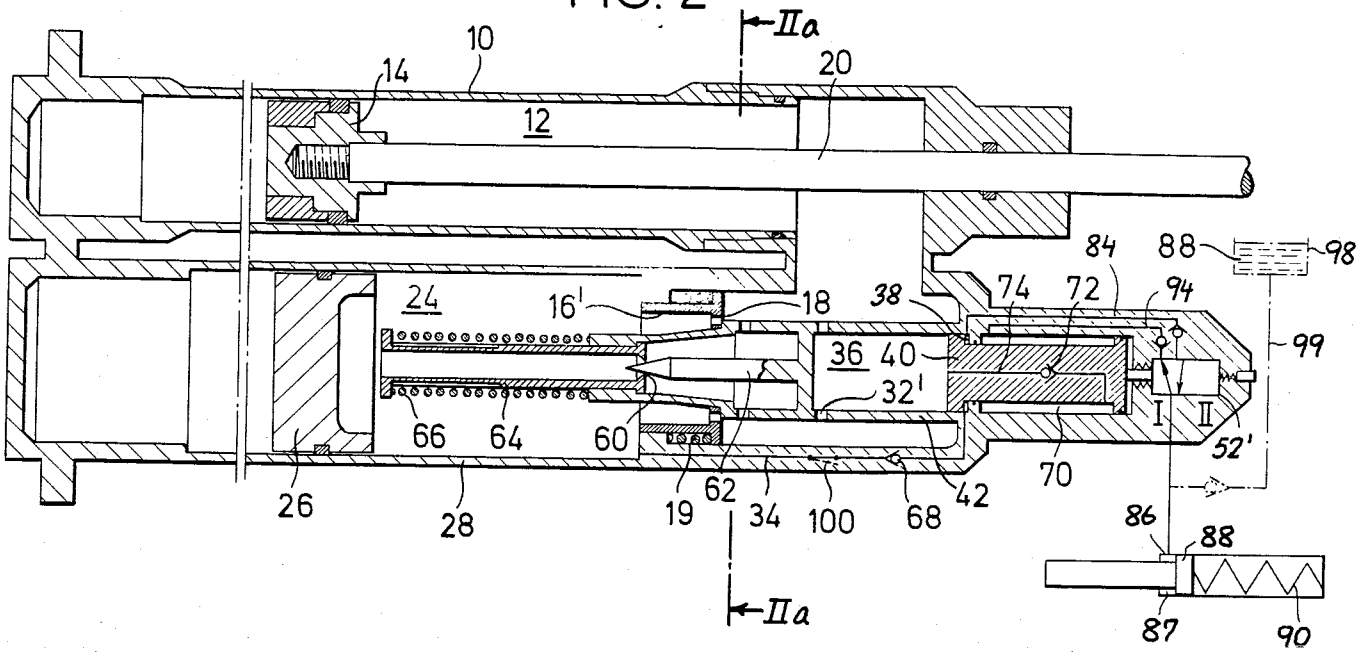
FIG. 2 shows an initial phase of the counter-recoil movement of the barrel in a second and refined version of my invention in elevation.
Figure 2A:
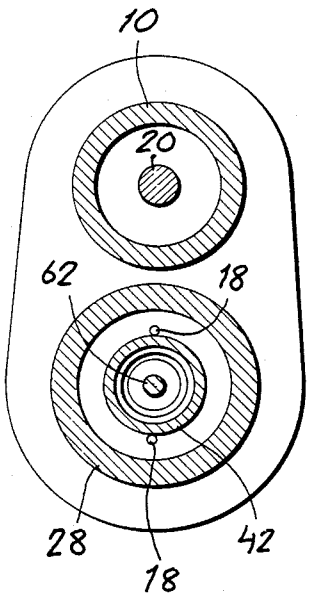
Figure 3:
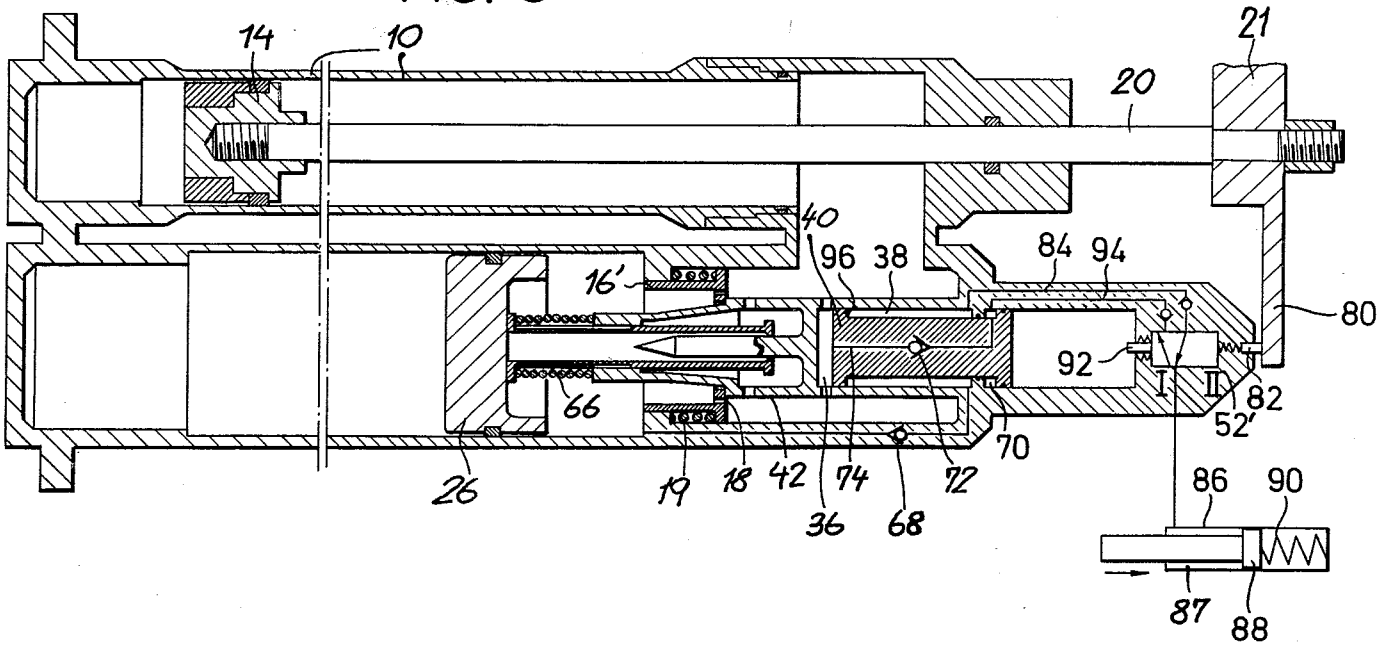
* and FIG. 3 shows an end phase of the counter-recoil movement of the barrel in the second version of my invention.

An alternate version of my invention shown in FIGS. 2 and 2*a* and 3 differs somewhat from the version shown in FIG. 1; to the extent that various parts are identical the same numerals have been used.

One recognizes again hydraulic cylinder 10, fluid-filled chamber 12 and piston 14, whose piston-rod 20 is again coupled to barrel 21 not shown in FIG. 2. FIG. 2 shows the position of piston 14 immediately after commencement of the counter-recoil phase, and FIG. 3 its position immediately prior to the conclusion of the counter-recoil phase. During the recoil phase piston 14 is entrained by barrel 21 to the right, and pushes the fluid via a disk valve 16′ located with accumulator 28 into a chamber 24, thereby displacing floating piston 26 to the left.

The counter-recoil movement takes place in a fashion similar to that illustrated in FIG. 1; disk valve 16′ closes first as a result of the action of spring 19. Fluid can pass via throttle openings 18 having a constant cross section as well as via a variable opening 60 between a tapered plug 62 and a guiding jacket 64. The latter can be displaced to the right against the action of a tension spring 66. It is the purpose of this arrangement to obtain a self-adjustment of the various throttling ratios, which are dependent on the charge and elevation of the barrel. For this reason also spring 66 is prestressed to only an extent for a given differential occurring across disk valve 16′ sufficient to cause a displacement of guiding jacket 64, this pressure differential being in turn obtainable only when barrel 21 has exceeded a predetermined velocity. If variable opening 60 is narrowed the throttling is increased and consequently and additional braking effect obtained.

Any further counter recoil movement causes floating piston 26 to impact with the frontal side of guiding jacket 64 and consequently to displace the latter to the right, thereby partially or almost completely closing variable opening 60. Barrel 21 and piston 14 connected thereto continue moving to the left as a result of their inertia; since, however, an adequate amount of fluid can no longer pass through throttle openings 18, the former is obtained from a chamber 36 of a cylinder 42, which forms an integral part of the counter-recoil and braking system. A chamber 38 is supplied via a line 34 having a check valve 68; the fluid entering the former forces piston 40 to move to the left. Cylinder 42 is further formed with boreholes 32′ also serving as fluid-supply conduits and with an additional chamber 70, which is designated as a vacuum-chamber; the latter is emptied via a check-valve 72 into a line 74 during the displacement of piston 40 to the left, which finally reaches the position shown in FIG. 3.

Just prior to the completion of the counter-recoil movement a guiding head 80 effectively coupled to barrel 21 and moving to the left impacts with an actuating plunger 82 of a valve 52, the latter being laterally movable within the frontal portion of cylinder 42, connecting chamber 38 via a line 84 with an actuating cylinder 86 of, for example, a driving mechanism. Piston 40 can thereafter move again to the right, and actuating piston 88 is displaced against the action of a spring 90. As soon as piston 40 now moving to the right impacts with another plunger 92 of valve 52, a cylindrical chamber 81 of actuating cylinder 86 is connected via a line 94 with vacuum space 70; the underpressure resulting therein supports the return movement of actuating piston 88, to its rest position, i.e. sliding to the left in FIG. 3, the force of spring 90 acting on piston 88 aiding that movement.

A seal 96 ensures that the hydraulic circulation to the right of that seal (vacuum chamber 70, lines 84 and 94 and actuating cylinder 86) is under no pressure in the rest position of actuating piston 88. The hydraulic circulation can be connected to a reservoir 98 to compensate for any leakage losses, the latter also being usable as a vent; such a connection is shown by a dash-dot-dash line 99 in FIG. 2. Also shown dotted is a manually actuable switch 100 for line 34, which serves to disconnect cylinder 42 from any fluid supply. It is to be understood that a manual control for valve 52′ could also be used in lieu of an automatic control, or that such a control could be exercised by other elements of the weapon.

I claim:

1. A weapon comprising:

a recoilable barrel;

a hydraulic cylinder having a main piston connected to said barrel:

a primary accumulator containing a compressed gas and connected to said cylinder for displacement by hydraulic fluid forced from said cylinder into said accumulator by said piston upon movement of said barrel, the gas in said primary accumulator storing recoil energy of the barrel in the form of gas pressure and enabling retrieval of recoil energy;

an auxiliary energy accumulator having an auxiliary piston exposed to a pressure difference during retrieval of energy from said primary accumulator, said auxiliary piston having small and large effective surfaces, said pressure difference displacing said auxiliary piston in the direction of said large surface, said auxiliary accumulator being formed with first and second chambers on opposite sides of said auxiliary piston;

means connected to said hydraulic cylinder for transmission of fluid pressure in said hydraulic cylinder to said chambers during a firing position of said barrel, said auxiliary accumulator being formed as an auxiliary cylinder having a third chamber; and an actuating cylinder connected to said third chamber, said third chamber acting selectively as a pumping-pressure and vacuum chamber of said actuating cylinder.

2. The weapon defined in claim 1 wherein said actuating cylinder and said accumulators have respective first and second hydraulic circulation paths, said first circulation path being disconnectable from said second circulation path.

3. The weapon defined in claim 2, further comprising a seal attached to said auxiliary cylinder and separating said first and second hydraulic circulation paths in a first position of the auxiliary cylinder.

4. The weapon defined in claim 3, further comprising an equalizing reservoir connected to said first circulation path.

5. A weapon comprising:

a recoilable barrel;

a hydraulic cylinder having a main piston connected to said barrel and displaceable therewith;

an energy accumulator comprising another cylinder communicating with said hydraulic cylinder, said accumulator being provided with a secondary piston displaceable by hydraulic fluid from said hydraulic cylinder to compress a gas in said other cylinder;

a valve between said cylinders having a first position permitting substantially unrestricted flow of hydraulic fluid from said hydraulic cylinder into said other cylinder and a secondary position permitting only throttle flow of hydraulic fluid from said other cylinder into said hydraulic cylinder;

a further cylinder operable at least in part by recoil energy stored in compression of said gas, said further cylinder being provided with a working piston and a pair of working chamber flanking said working piston and adapted to receive fluid to displace said working piston; and means for applying hydraulic fluid pressure from opposite sides of said valve to said chambers, thereby displacing said working piston with the pressure differential across said valve.

6. The weapon defined in claim 5 wherein said working piston has opposite surfaces of different effective surface area exposed to a fluid in said chambers.

7. The weapon defined in claim 5 wherein the last-mentioned means includes a duct extending between said hydraulic cylinder and one of said chambers on one side of said valve, another duct extending between said other cylinder and the other of said chambers on the opposite side of said valve, and a further valve means interconnecting said ducts for selectively shunting said chambers together.

8. The weapon defined in claim 5 wherein said valve is a disk valve comprising a valve seat, a disk displaceable relative to said seat, means biasing said disk toward said seat, and means forming at least one throttling opening in said disk.

* * * * *